United States Patent [19]

Bisaiji et al.

[11] Patent Number: 4,875,079

[45] Date of Patent: Oct. 17, 1989

[54] TONER DENSITY CONTROL FOR MULTICOLOR ELECTROPHOTOGRAPHIC COPIER

[75] Inventors: Takashi Bisaiji, Yokohama; Noboru Sawayama; Hideo Yoo, both of Tokyo, all of Japan

[73] Assignee: Ricoh Company, Ltd., Tokyo, Japan

[21] Appl. No.: 170,264

[22] Filed: Mar. 18, 1988

[30] Foreign Application Priority Data

Mar. 19, 1987 [JP] Japan ..... 62-64596
Mar. 19, 1987 [JP] Japan ..... 62-64597

[51] Int. Cl.[4] ..... G03G 15/08; G03G 15/01
[52] U.S. Cl. ..... 355/246; 355/326
[58] Field of Search ..... 355/4, 300, 140, 208, 355/214, 246, 326; 118/688–91, 665

[56] References Cited

U.S. PATENT DOCUMENTS 4,579,443 4/1986 Abuyama et al. ..... 355/4
4,742,372 5/1988 Takahashi ..... 355/4 X
4,754,301 6/1988 Kasamura et al. ..... 355/4 X

FOREIGN PATENT DOCUMENTS 58-113947 7/1983 Japan ..... 355/4
59-101260 7/1984 Japan ..... 355/4
60-98462 6/1985 Japan ..... 355/4
61-272767 12/1986 Japan ..... 355/300

*Primary Examiner*—Arthur T. Grimley
*Assistant Examiner*—J. Pendergrass
*Attorney, Agent, or Firm*—Oblon, Spivak, McClelland, Maier & Neustadt

[57] ABSTRACT

A device for controlling the density of toner of different colors individually stored in a plurality of developing units which are arranged around a photoconductive element senses toner density at a predetermined period which differs from one of the developing units to another. Each of the developing units is associated with a different kind of toner density sensing device.

14 Claims, 9 Drawing Sheets

TONER DENSITY CONTROL FOR MULTICOLOR ELECTROPHOTOGRAPHIC COPIER

BACKGROUND OF THE INVENTION

The present invention relates to a multicolor image recorder using toner of a plurality of colors as a developer and, more particularly, to a device applicable to such an image recorder for controlling the density of toner.

A recent achievement in the realm of imaging art is a multicolor electrophotographic copier having a plurality of developing units which are arranged around a photoconductive element and each stores toner of a different color. In this kind of copier, one of the developing units which is designated by an operator is actuated to develop an electostatic latent image provided on the photoconductive element by the toner of particular color which is stored in that unit. Specifically, a first and a second developing unit which store, for example, red toner and black toner, respectively, are disposed around a photoconductive element in such a manner as to be movable toward and away from the latter. As an operator manipulates a mode switch provided on an operation board to select a particular mode, any of the first and second developing units which is associated with that mode is brought close to the surface of the photoconductive element. Then, a sequence of copying steps known in the art, i.e., charging, exposing, developing and transferring steps are effected to produce a copy in a desired color.

In the case that each of the first and second developing units stores a two-component developer which is made up of toner and carrier, the mixture ratio of toner and carrier has to be maintained constant in order to uniformize the density of reproduced images by controlling the density of toner. An implementation heretofore adopted for the toner density control is such that an exclusive density pattern is produced by particular toner in a non-image area of the photoconductive element at a predetermined period, the density of such a pattern is sensed in terms of an amount of reflected light by a reflection type sensor which is constituted by a light emitting element (LED) and a light sensitive element (P sensor) as well known in the art, and the amount of reflected light sensed is converted into an electric signal. More specifically, the toner density is sensed by comparing an output of the P sensor which is associated with those areas before and after the density pattern which have been erased (substantially constant) and an output of the P sensor which is associated with the density pattern (variable with toner density). As regards the period for sensing toner density, the sensing operation may be effected with a copy produced first after the turn-on of a main switch and every tenth copy which follows the first copy. When it is decided that toner density is short, toner is continuously supplied to a particular developing unit copy by copy until the next timing for sensing toner density is reached, e.g., up to the tenth copy. Since the light to which the P sensor is responsive is selected to be infrared light, the toner density control is accomplished with no regard to the color of toner despite that the detection level of the P sensor is variable. Hence, identical optical sensors are individually associated with toner of different colors or, alternatively, a single optical sensor is shared by toner of different colors.

A problem with the prior art electrophotographic copier described above stems from the fact that the first developing unit storing red toner and the second developing unit storing black toner which is used more frequently than red toner have, in many cases, different capacity from each other. Should the toner density associated with the individual developing units be sensed at the same period, the toner density associated with the second developing unit would be scattered far more significantly than that associated with the first developing unit rendering the density of reproduced images unstable.

Furthermore, the deterioration of red toner stored in the first or smaller developing unit due to aging is apt to occur at a higher rate than that of black toner which is stored in the second or larger developing unit. It follows that, when identical optical sensors are used to control the density of the toner of different colors, the red toner is determined to be short due to aging even when its density is appropriate. The result is an excessive supply of red toner which would bring about smears in the background area of a copy as well as mechanical troubles ascribable to toner being scattered around.

SUMMARY OF THE INVENTION

It is, therefore, an object of the present invention to provide a toner density control device for a multicolor electrophotographic copier which reduces the scattering of toner density.

It is another object of the present invention to provide a toner density control device for a multicolor electrophotographic copier which eliminates the supply of an excessive amount of toner.

It is another object of the present invention to provide a generally improved toner density control device for a multicolor electrophotographic copier.

In accordance with the present invention, there is provided a toner density control device for an image recorder which has a plurality of developing units arranged around a photoconductive element and selectively moves the developing units toward the photoconductive element according to a particular mode selected to develop an electrostatic latent image which is provided on the photoconductive element by toner of particular color which is stored in the developing unit. The device comprises toner supplying means each being associated with a respective one of the developing units for supplying toner to the developing unit associated, sensing means responsive to the density of each of the toner stored in the individual developing units for producing a sense signal representative of the density, mode specifying means for specifying the mode and generating a mode signal which is representative of the mode specified, and control means responsive to the sense signal from the sensing means and the mode signal from the mode specifying means for generating a control signal which controls each of the toner supplying means, thereby maintaining the density of toner stored in each of the developing units constant. The control means controls the sensing means such that the sensing means senses at a predetermined period the density of toner stored in one of the developing units which has been selected by the mode specified.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
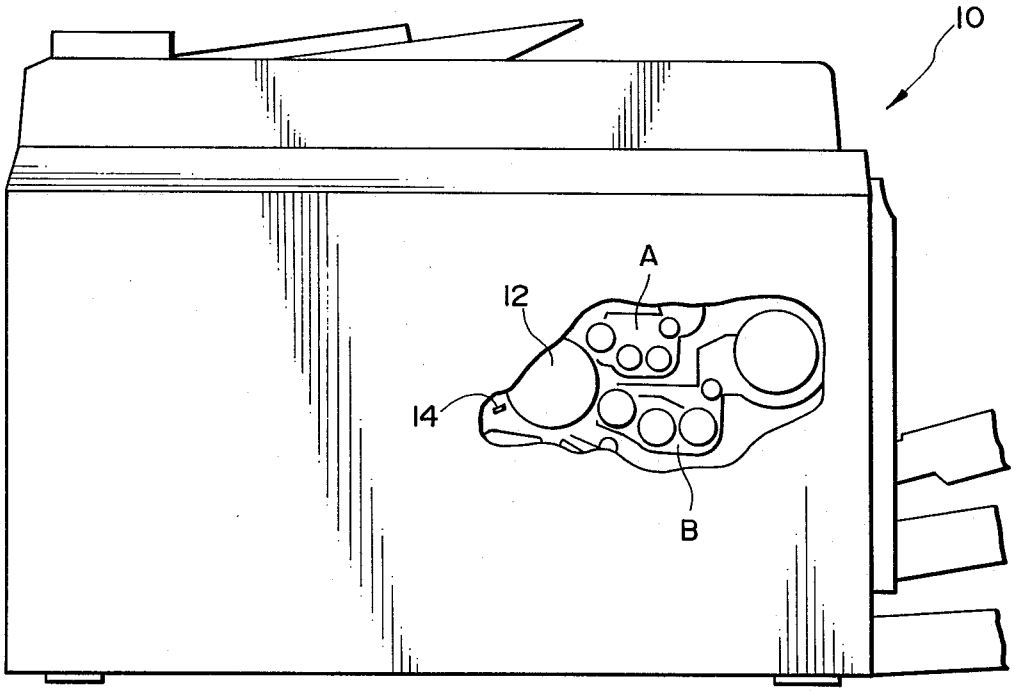
FIG. 1 PRIOR ART
FIG. 1 is a partly sectional elevation of a prior art electrophotographic copier, particularly a developing device and an optical sensor which are arranged around a photoconductive element.

To better understand the present invention, a brief reference will be made to a prior art electrophotographic copier capable of developing an electrostatic latent image on a photoconductive element by toner of desired color, shown in FIG. 1. As shown, the copier 10 includes a first and a second developing unit A and B which store, for example, red toner and black toner, respectively, and are disposed around a photoconductive element 12 in such a manner as to be movable toward and away from the latter. As an operator manipulates a mode switch (not shown) provided on an operation board to select a particular mode, any of the first and second developing units A and B which is associated with that mode is brought close to the surface of the photoconductive element 12. Then, a sequence of copying steps known in the art, i.e., charging, exposing, developing and transferring steps are effected to produce a copy in a desired color. An optical sensor 14 is positioned in the vicinity of the photoconductive element 12 for sensing the density of an exclusive density pattern which is produced by particular toner in a non-image area of the photoconductive element 12 at a predetermined period, in terms of an amount of reflected light. The sensor 14 is constituted by a light emitting element (LED) and a light sensitive element (P sensor) as well known in the art, and the amount of reflected light sensed is converted into an electric signal. More specifically, the toner density is sensed by comparing an output of the P sensor which is associated with those areas before and after the density pattern which have been erased (substantially constant) and an output of the P sensor which is associated with density pattern (variable with toner density). As regards the period for sensing toner density, the sensing operation is effected with a copy produced first after the turn-on of a main switch and every tenth copy which follows the first copy by way of example. When it is decided that toner density is short, toner is continuously supplied to a particular developing unit copy by copy until the next timing for sensing toner density is reached, e.g., up to the tenth copy.

Figure 2:
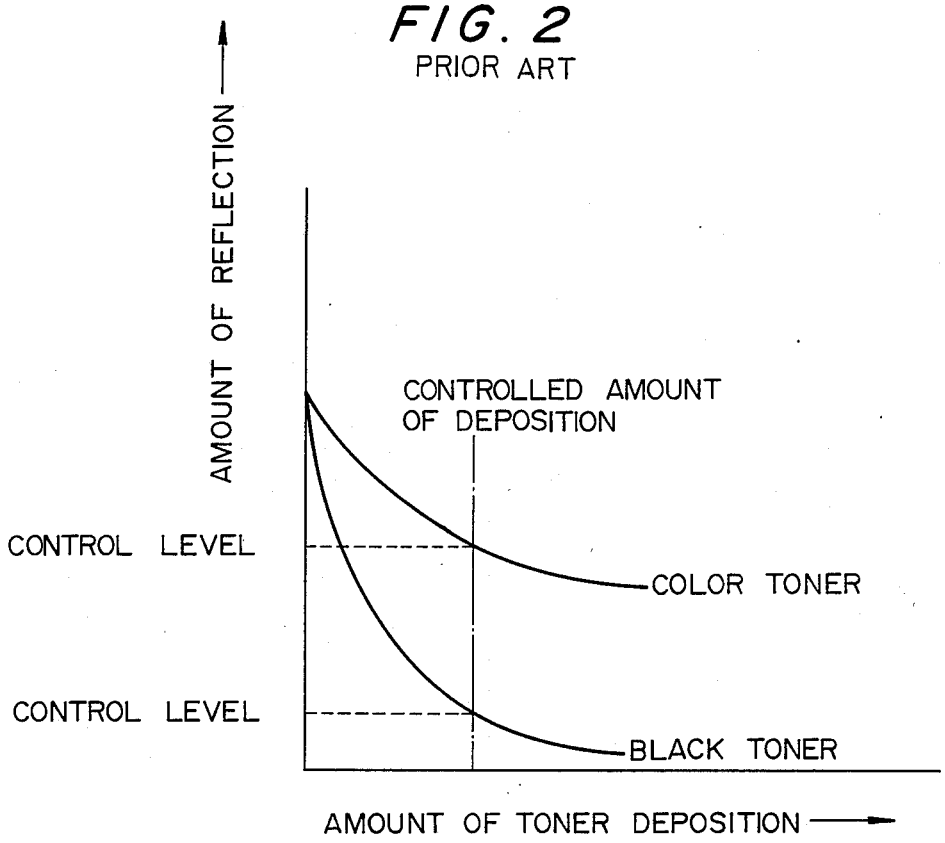
FIG. 2 PRIOR ART
FIG. 2 is a plot showing a relationship between the amount of toner deposition on a photoconductive element and the amount of light reflected.

FIG. 2 shows a relationship between the amount of toner deposited on photoconductive element and the amount of light reflected. As shown, if the light to which the P sensor is responsive is selected to be infrared rays, the toner density control is accomplished with no regard to the color of toner despite that the detection level of the P sensor is variable. Hence, in the prior art copier 10, only a single optical sensor 14 is used for toner density control.

Figure 3:
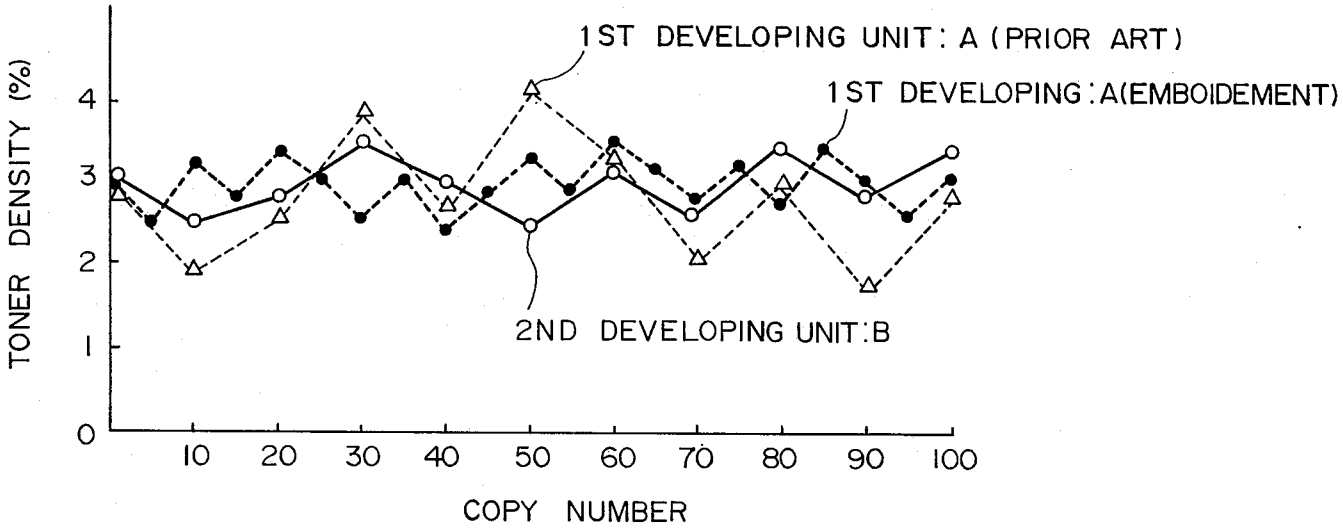
FIG. 3 PRIOR ART
FIGS. 3 and 4 are plots each showing a relationship between the number of copies produced and the density of toner.

A problem with the prior art copier 10 described above stems from the fact that the first developing unit A storing red toner and the second developing unit B storing black toner which is used more frequently than red toner have, in many cases, different capacity from each other, as stated earlier. Should the toner density associated with the individual developing units be sensed at the same period by the optical sensor 14, the toner density associated with the second developing unit B would be scattered far more significantly than that associated with the first developing unit A resulting in unstable density of reproduced images, as shown in FIG. 3 by way of example.

Figure 4:
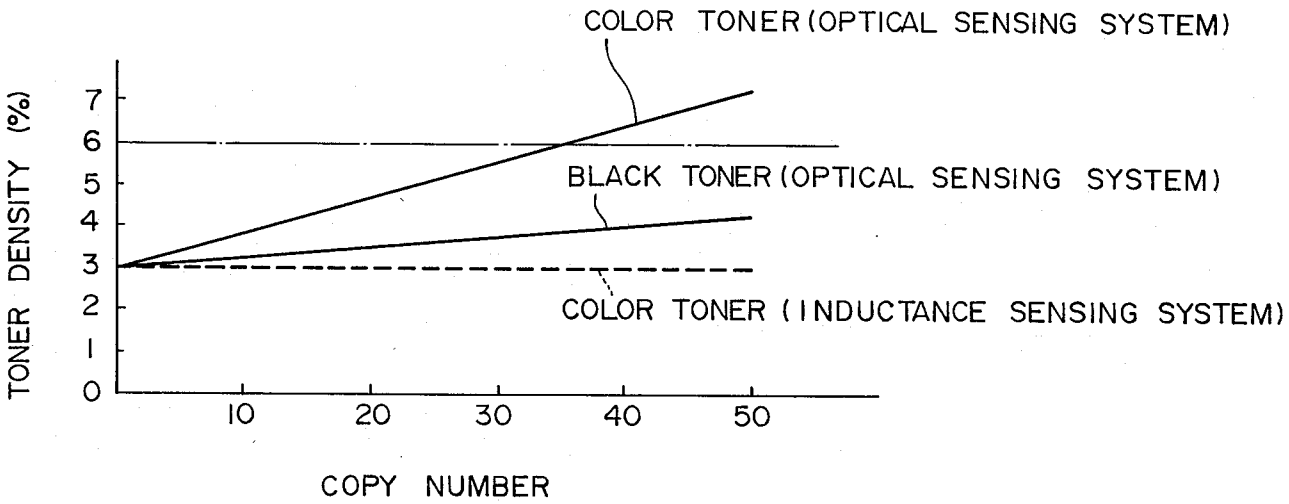
FIG. 4 PRIOR ART

Furthermore, the deterioration of red toner stored in the first or smaller developing unit A due to aging is apt to occur at a higher rate than that of black toner which is stored in the second or larger developing unit B. It follows that, when identical optical sensors are used to control the density of the toner of different colors, the red toner is determined to be short due to aging even when its density is appropriate. The result is an excessive supply of red toner as shown in FIG. 4 which would bring about smears in the background area of a copy as well as mechanical troubles ascribable to toner being scattered around.

Hereinafter will be described preferred embodiments of the present invention which are free from the drawback particular to the prior art as discussed above.

First Embodiment

Figure 5:
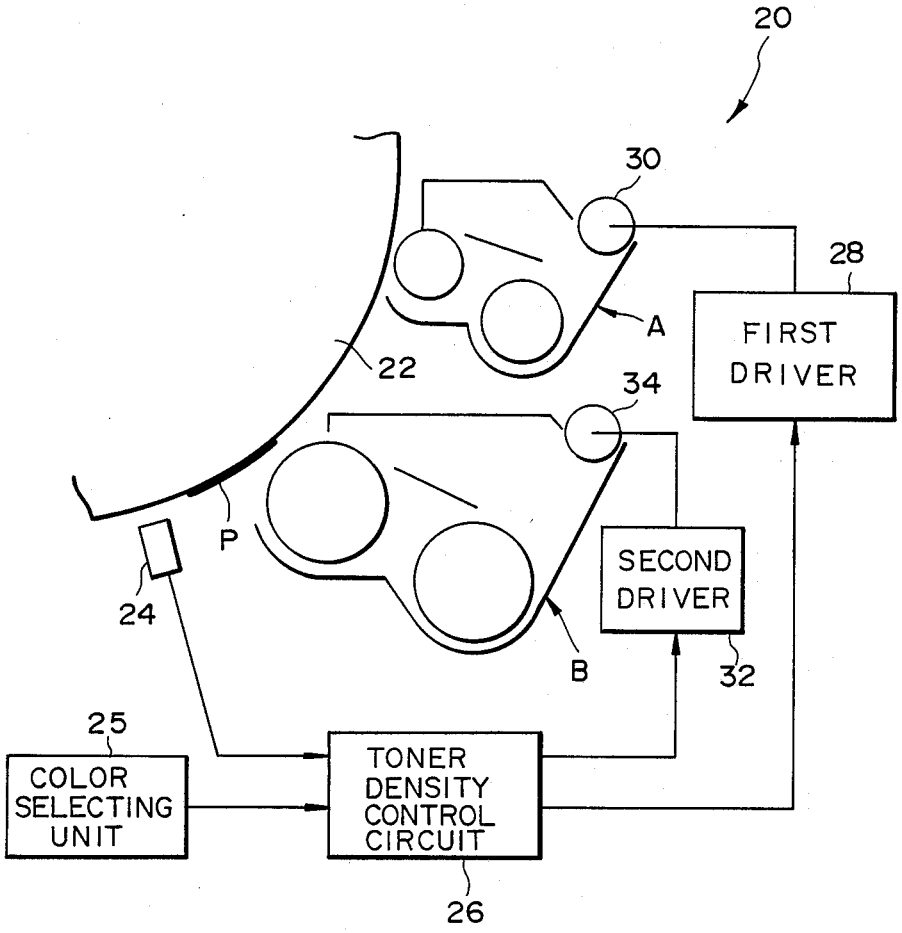
FIG. 5 is a schematic block diagram showing a first embodiment of a toner density control device in accordance with the present invention and which is installed in an electrophotographic copier.

Referring to FIG. 5, an electrophotographic copier to which a first embodiment of a toner density control device in accordance with the present invention is shown and generally designated by the reference numeral 20. As shown, a first developing unit A storing red toner and a second developing unit B storing black toner and having larger capacity than the unit A are arranged around a photoconductive element 22 which, in the illustrative embodiment, is in the form of a drum. The developing units A and B are individually movable toward and away from the drum 22. An optical sensing unit 24 is located in the vicinity of a non-image area of the drum 22 so as to sense a density pattern P which is provided in that area. The sensing unit 24 may be implemented with a reflection type photosensor which is made up of a light emitting element (LED) and a light sensitive element (P sensor), as well known in the art. When the density of the density pattern in high, the output of the P sensor becomes a low level resulting that a toner interrupt signal which has a low level being produced. Conversely, when the density of the density pattern is low, it becomes a high level being resulting that a toner supply signal which has a high level produced. These outputs of the sensor 24 are fed to a toner density control circuit 26. Also fed to the toner density control circuit 26 is an output of a color selecting unit 25 which is responsive to an output of a mode switch which may be manipulated by an operator for designating toner of desired color. The output of the toner density control circuit 26 is connected to a first and a second driver 28 and 32 which are adapted to drive a first toner supply roller 30 of the first developing unit A and a second toner supply roller 34 of the second developing unit B, respectively. The drivers 28 and 32 may each be constructed to rotate the roller 30 or 34 associated therewith for a predetermined period of time by turning on and off a toner supply solenoid which is well known in the art.

Figure 6:
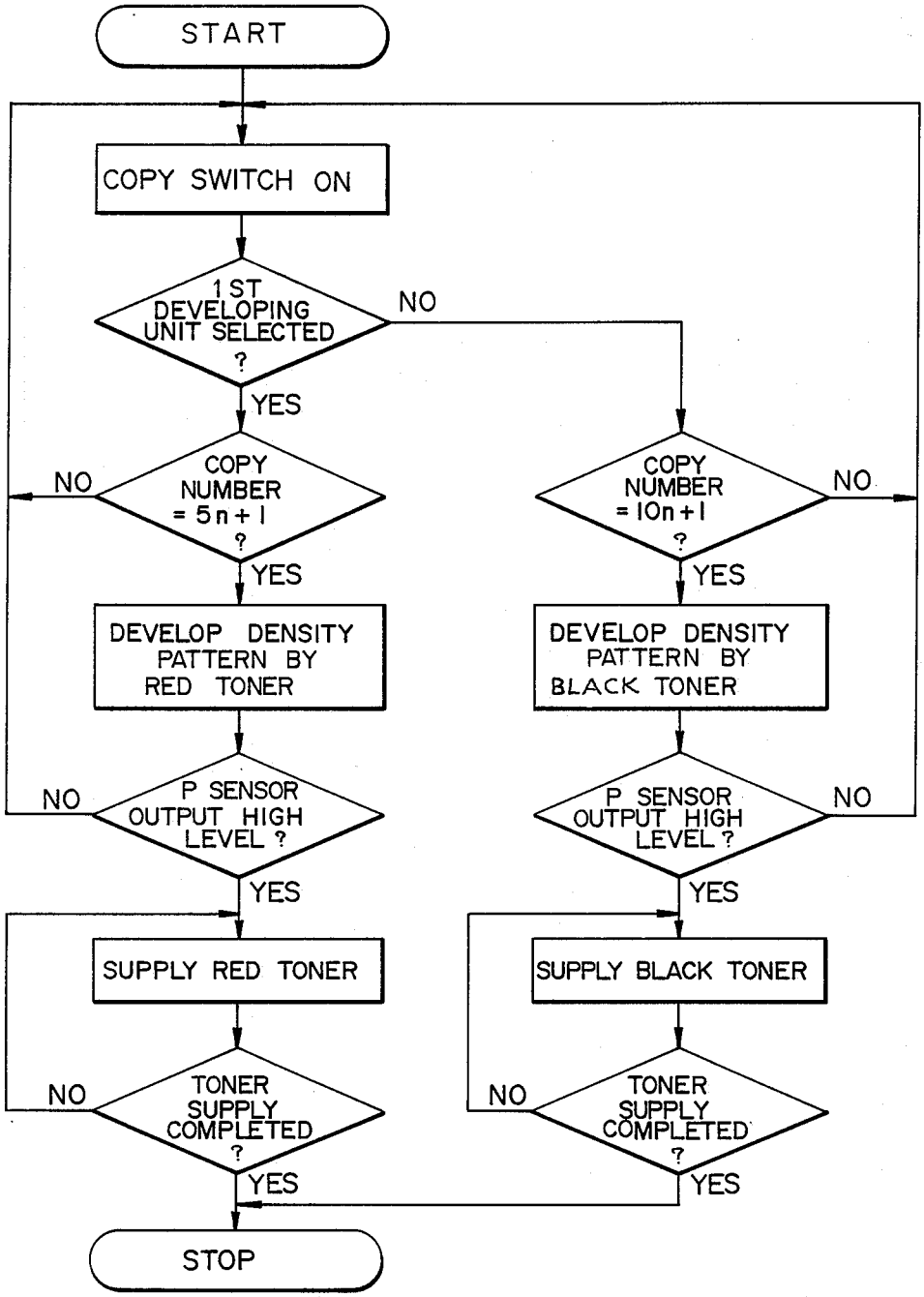
FIG. 6 is a flowchart demonstrating a specific operation of the control device as shown in FIG. 5.

The toner density control circuit 26 controls the drivers 28 and 32 in response to an output of the optical sensing unit 24 and that of the color selecting unit 25. Specifically, as shown in FIG. 6, when a main switch (not shown) of the copier 20 is turned on, the circuit 26 is enabled. As a copy switch (not shown) of the copier 20 is operated to start a copying cycle, the circuit 26 determines which of the developing units A and B has been designated for developing a latent image, in response to an output of the color selecting unit 25. The circuit 26 causes the developing unit A to be moved toward the drum 22 when the operator has selected red toner and causes the developing unit B to be so moved when the operator has selected black toner.

When it is the developing unit A that has been selected, the sensing unit 24 is conditioned for a mode in which a density pattern is developed by red toner every time five copying cycles are executed and sensed by the unit 24. If the output of the sensing unit 24, i.e., that of the P sensor has a high level, red toner is supplied to the developing unit A by an amount which has been programmed beforehand. Upon completion of such a toner supply, the operation is stopped. On the other hand, when it is the developing unit B that has been designated, the sensing unit 24 is conditioned for another mode in which a density pattern is developed by black toner every time ten copying cycles are completed and sensed by the unit 24. In this case, if the output of the P sensor has a high level, black toner is fed to the developing unit B by a particular amount as programmed beforehand.

It is to be noted that the kinds of toner stored in the two developing units A and B as well as the sensing modes (e.g. timings) mentioned above are only illustrative.

As described above, in the first embodiment of the present invention, a different sensing mode is assigned to each of toner which are stored in the developing units A and B. This allows the individual toner to be supplied by an amount and at timing which are optimal for the toner of particular color and the capacity of the developing unit which stores it. Consequently, scattering of toner density due to a difference in capacity between the developing units A and B is reduced.

Second Embodiment

Figure 7:
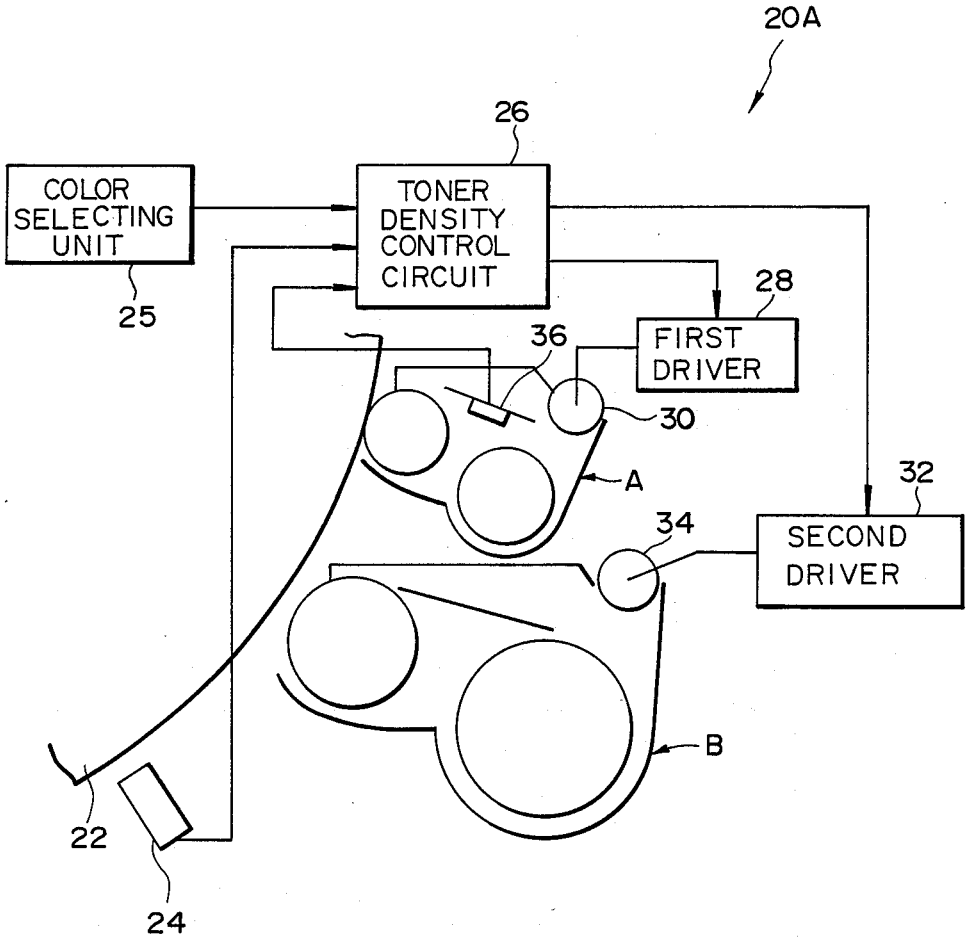
FIG. 7 is a schematic block diagram showing a second embodiment of the toner density control device in accordance with the present invention and which is also installed in an electrophotographic copier.
Figure 8:
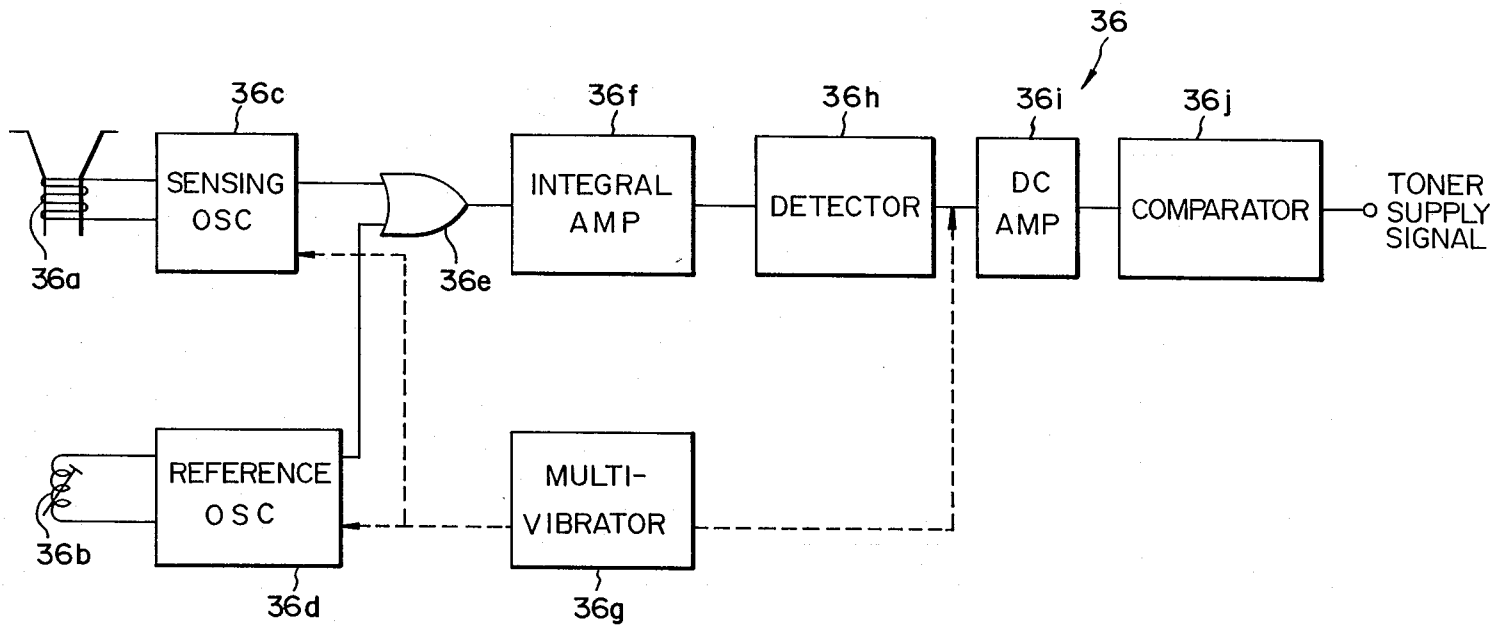
FIG. 8 is a schematic block diagram representative of a specific construction of an inductance sensing unit which is included in the control device of FIG. 7.

Referring to FIG. 7, an electrophotographic copier 20A to which a second embodiment of the present invention is applied is shown. In FIG. 7, the same or similar structural elements as those shown in FIG. 5 are designated by like reference numerals. In this particular embodiment, the density of toner stored in the first developing unit A, e.g., red toner is sensed by an inductance sensing unit 36 while the density of toner stored in the second developing unit B which has a larger capacity and is used more frequently than the unit A, e.g., black toner is sensed by the optical sensing unit 24. A specific construction of the inductance sensing unit 36 is shown in FIG. 8. The unit 36 shown in FIG. 8 includes a sensing coil 36*a*, a reference coil 36*b*, a sensing oscillator 36*c*, a reference oscillator 36*d*, a gate 36*e*, an integral amplifier 36*f*, a multivibrator 36*g*, a detector 36*h*, a DC amplifier 36*i*, and a comparator 36*j*. The principle of operation of the device 36 is such that when the developer flows through the sensing coil 36*a*, the inductance of the sensing coil 36*a* is changed due to a change in permeability which in turn is ascribable to a change in toner density, i.e. in the mixture ratio of carrier and toner.

In detail, when the inductance of the sensing coil 36*a* is changed, the oscillation frequency of the sensing oscillator 36*c* is changed. On the other hand, the reference coil 36*b* is provided with fixed inductance which is associated with an adequate toner density. The oscillation frequency of the reference oscillator 36*d* which is associated with the reference coil 36*b* and the oscillation frequency of the sensing oscillator 36*c* are added, then amplified by the integral amplifier 36*f*, then detected by the detector 36*h*, and then amplified by the DC amplifier 36*i*. If the toner density in the developing unit A is high, the inductance of the sensing coil 36*a* is lowered so that the output frequency of the sensing oscillator 36*c* is raised. As a result, the output of the comparator 36*j* becomes a low level to produce a toner interrupt signal which has a low level. Conversely, if the toner density in the developing unit A is low, the inductance of the sensing coil 36*a* is increased to in turn lower the output frequency of the sensing oscillator 36*c*. In this case, therefore, the output of the comparator 36*j* becomes a high level to produce a toner supply signal which has a high level. The output of the inductance sensing unit 36 is applied to the toner density control circuit 26. Also applied to the toner density control circuit 26 are an output of the color selecting unit 25 and an output of the optical sensing unit 24 which individually function in the same manner as described in relation to the first embodiment.

Connected to the output of the toner density control circuit 26 are the first and second drivers 28 and 32 for driving the first and second toner supply rollers 30 and 34, respectively, as also described in relation to the first embodiment. Again, each of drivers 28 and 32 may be of the type rotating the roller 30 or 34 associated therewith for a predetermined period of time by turning on and off a toner supply solenoid which is well known in the art.

Figure 9:
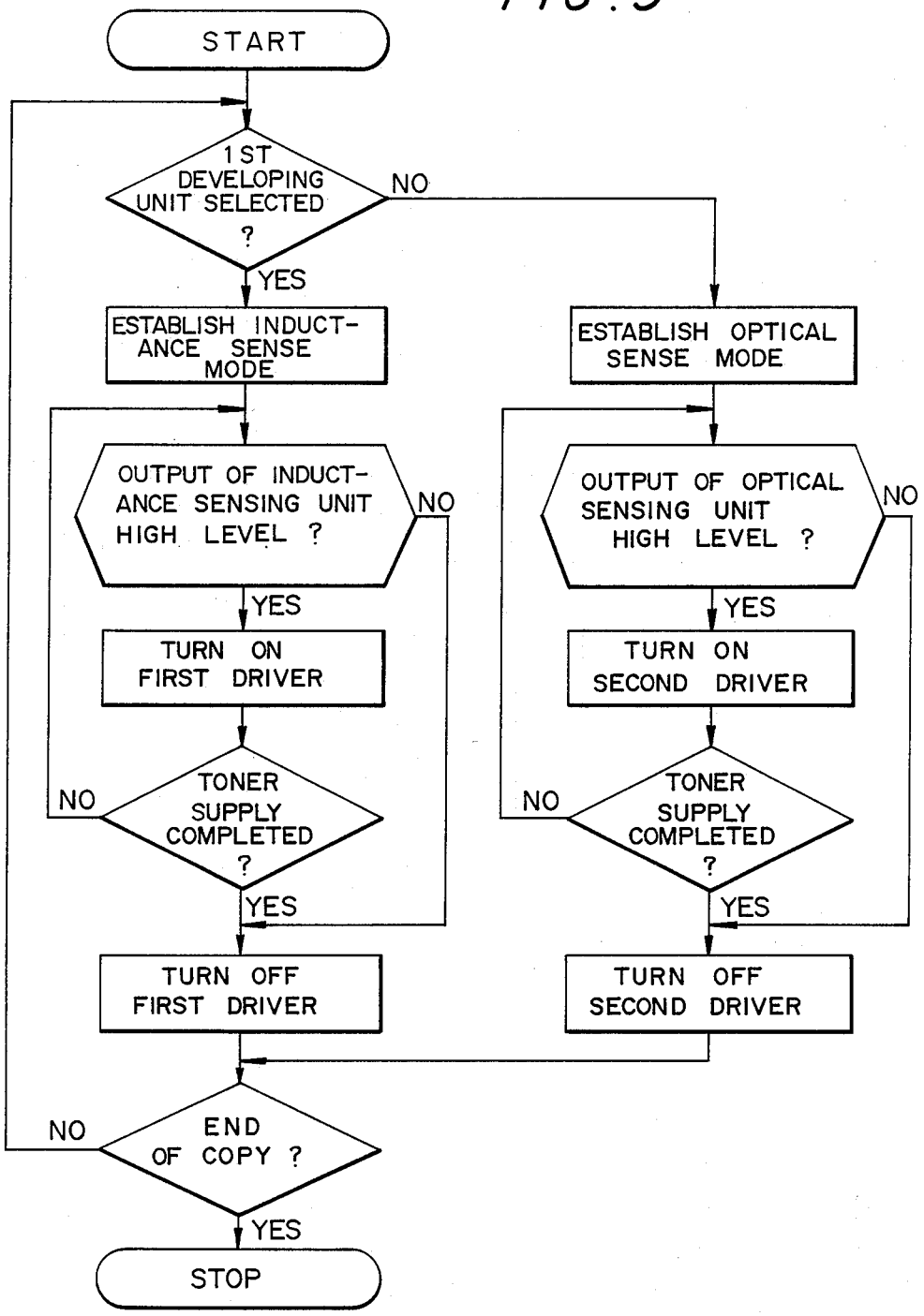
FIG. 9 is a flowchart showing a specific operation of the control device as shown in FIG. 7.

The toner density control circuit 26 controls the drivers 28 and 32 in response to outputs of the optical sensing unit 24, inductance sensing unit 36 and color selecting unit 25. Specifically, as shown in FIG. 9 by way of example, upon turn-on of a copy switch (not shown) of the copier 20A the toner density control circuit 26 determines which of the developing units A and B has been designated in response to an output of the color selecting device 25. The developing unit A is brought close to the drum 22 when the operator has selected red toner, and the developing unit B is brought close to the drum 22 when the operator has selected black toner.

Assuming that the developing unit A has been selected, an inductance sense mode is set up so that whether the output of the inductance sensing unit 36 has a low level or a high level is determined according to a predetermined program. If it has a high level, the driver 28 is enabled to supply red toner to the developing unit A. Upon the completion of a predetermined toner supply (a preprogramed frequency of toner supply), the driver 28 is disenabled. Then, the copying operation is stopped after whether or not it is completed has been determined. On the other hand, when it is the other developing unit B that has been selected, an optical sense mode is set up in which the other driver 32 is enabled in response to an output of the optical sensing unit 24 and, hence, black toner is fed to the developing unit B. Afterwards, the driver 32 like the driver 28 is disenabled after a predetermined toner supply has been completed according to a predetermined program.

As stated above, the second embodiment of the present invention allows the toner density control associated with the developing unit A and the toner density control associated with the developing unit B to be executed according to individual programs in response to the outputs of different kinds of sensing units. Hence, an excessive toner supply due to the difference between the colors of toner and between the developing units A and B with respect to capacity is eliminated.

Various modifications will become possible for those skilled in the art after receiving the teachings of the present disclosure without departing from the scope thereof.

What is claimed is:

1. A toner density control device for an image recorder which has a plurality of developing units arranged around a photoconductive element and selectively moves said developing units toward said photoconductive element according to a particular mode selected to develop an electrostatic latent image which is provided on said photoconductive element by toner of particular color which is stored in said developing unit, said device comprising:

toner supplying means each being associated with a respective one of said developing units for supplying toner to said developing unit associated;

sensing means responsive to the density of each of said toner stored in said individual developing units for producing a sense signal representative of said density;

mode specifying means for specifying said mode and generating a mode signal which is representative of said mode specified; and control means responsive to said sense signal from said sensing means and said mode signal from said mode specifying means for generating a control signal which controls each of said toner supplying means, thereby maintaining the density of toner stored in each of said developing units constant;

said control means controlling said sensing means such that said sensing means senses at a predetermined period the density of toner stored in one of said developing units which has been selected by said mode specified, wherein said period differs from one of said developing units to another.

2. A toner density control device as claimed in claim 1, wherein each of said toner supplying means comprises a toner supply roller for supplying toner to said developing unit, and a driver for controllably driving said toner supply roller in response to said control signal from said control means.

3. A toner density control device as claimed in claim 1, wherein said sensing means comprises optical sensing means for optically sensing an amount of toner deposited on a density pattern which is provided on a non-image area of said photoconductive element.

4. A toner density control device as claimed in claim 3, wherein said optical sensing means comprises light emitting means for emitting infrared light and a photosensor for generating said sense signal by receiving said infrared light.

5. A toner density control device as claimed in claim 4, wherein said sense signal has a low level when the density of said density pattern in high and has a high level when said density is low.

6. A toner density control device as claimed in claim 1, wherein said mode specified by said mode specifying means includes a mode for specifying any of said developing units which stores toner of desired color.

7. A toner density control device as claimed in claim 6, wherein said mode further includes a mode for setting said predetermined period on a developing unit basis.

8. A toner density control device as claimed in claim 1, wherein said developing units comprise at least a first developing unit and a second developing unit which has a greater capacity than said first developing unit.

9. A toner density control device as claimed in claim 8, wherein said sensing means comprises first sensing means and second sensing means responsive to the density of toner stored in said first developing unit and the density of toner stored in said second developing unit, respectively.

10. A toner density control device as claimed in claim 9, wherein said first sensing means comprises inductance sensing means which has a sensing coil for sensing the density of toner on the basis of a change in inductance which occurs when said toner flows through said sensing coil.

11. A toner density control device as claimed in claim 9, wherein said second sensing means comprises optical sensing means for optically sensing an amount of toner deposited by said second developing unit on a density pattern which is provided in a non-image area of said photoconductive element.

12. A toner density control device as claimed in claim 11, wherein said optical sensing means comprises light emitting means for emitting infrared light and a photosensor for generating said sense signal by receiving said infrared light.

13. A toner density control device as claimed in claim 12, wherein said sense signal has a low level when the density of said density pattern in high and has a high level when said density is low.

14. A toner density control device for an image recorder which has a plurality of developing units arranged around a photoconductive element and selectively moves said developing units toward said photoconductive element according to a particular mode selected to develop an electrostatic latent image which is provided on said photoconductive element by toner of particular color which is stored in said developing unit, said device comprising:

toner supplying means each being associated with a respective one of said developing units for supplying toner to said developing unit associated;

sensing means responsive to the density of each of said toner stored in said individual developing units for producing a sense signal representative of said density, said sensing means including an inductance sensing means and an optical sensing means, said inductance sensing means including a sensing coil for sensing the density of toner on the basis of a change in inductance which occurs when said toner flows through said sensing coil, said optical sensing means sensing an amount of toner deposited by said second developing unit on a density pattern which is provided in a non-image area of said photoconductive element;

mode specifying means for specifying said mode and generating a mode signal which is representative of said mode specified; and control means responsive to said sense signal from said sensing means and said mode signal from said mode specifying means for generating a control signal which controls each of said toner supplying means, thereby maintaining the density of toner stored in each of said developing units constant;

said control means controlling said sensing means such that said sensing means senses at predetermined period the density of toner stored in one of said developing units which has been selected by said mode specified.

* * * * *